US012114715B2

(12) United States Patent
Polstein et al.

(10) Patent No.: US 12,114,715 B2
(45) Date of Patent: Oct. 15, 2024

(54) ATHLETIC GARMENT

(71) Applicant: Clearview Systems, LLC, Orlando, FL (US)

(72) Inventors: Jason Polstein, Orlando, FL (US); Matthew Polstein, Windermere, FL (US); Colleen Cotter, Winter Garden, FL (US); Allen Thompson, Orlando, FL (US)

(73) Assignee: Clearview Systems, LLC, Orlando, FL (US)

( * ) Notice: Subject to any disclaimer, the term of this patent is extended or adjusted under 35 U.S.C. 154(b) by 364 days.

(21) Appl. No.: 17/287,107

(22) PCT Filed: Oct. 15, 2019

(86) PCT No.: PCT/US2019/056265
§ 371 (c)(1),
(2) Date: Apr. 20, 2021

(87) PCT Pub. No.: WO2020/086330
PCT Pub. Date: Apr. 30, 2020

(65) Prior Publication Data

US 2021/0298369 A1 Sep. 30, 2021

Related U.S. Application Data

(60) Provisional application No. 62/749,449, filed on Oct. 23, 2018.

(51) Int. Cl.
*A41D 1/08* (2018.01)
*A41B 9/00* (2006.01)
(Continued)

(52) U.S. Cl.
CPC ..... *A41D 1/089* (2018.01); *A41B 9/00* (2013.01); *A41B 9/12* (2013.01); *A41D 31/125* (2019.02);
(Continued)

(58) Field of Classification Search
CPC ..... A41B 9/00; A41B 9/12; A41D 31/125; A41D 31/305; A41D 2600/10
See application file for complete search history.

(56) References Cited

U.S. PATENT DOCUMENTS 2,116,822 A * 5/1938 Berger ..... A41B 9/02 2/404
3,246,341 A * 4/1966 Paolucci ..... A41B 9/02 2/404
(Continued)

FOREIGN PATENT DOCUMENTS

WO 2004089614 A2 10/2004

OTHER PUBLICATIONS

Extended European search report, May 3, 2022, 9 pages.
(Continued)

*Primary Examiner* — Khaled Annis
(74) *Attorney, Agent, or Firm* — Baker Donelson; Carl M. Davis, II; Dorian B. Kennedy

(57) ABSTRACT

In an embodiment, an athletic garment is provided including a front panel and a rear panel, a waistband portion disposed at an upper portion of the garment, a first opening for receiving a torso of a user, a second opening for receiving a first leg of a user and a third opening for receiving a second leg of a user; and a crotch panel disposed between the front and rear panel, extending from the second opening to the third opening. The crotch panel comprises a tri-layered substrate to conceal and prevent visible staining of a fluid received therein. The tri-layered substrate may include a first
(Continued)

layer of a first material, a second layer of a second material, and a third layer of a third material.

18 Claims, 4 Drawing Sheets

(51) Int. Cl.
*A41B 9/12* (2006.01)
*A41D 1/089* (2018.01)
*A41D 31/12* (2019.01)
*A41D 31/30* (2019.01)

(52) U.S. Cl.
CPC ..... *A41D 31/305* (2019.02); *A41D 2600/10* (2013.01)

(56) References Cited

U.S. PATENT DOCUMENTS 3,687,141 A * 8/1972 Matsuda ..... A61F 13/74 604/397
5,105,473 A * 4/1992 Valtakari ..... A63B 71/08 2/24
5,497,511 A * 3/1996 Zade ..... A41D 13/0506 2/22
5,593,398 A * 1/1997 Weimer ..... A61F 13/74 604/360
6,401,250 B1 6/2002 McNabb
6,848,121 B1 2/2005 Halid
6,918,140 B1 7/2005 Cooper
8,318,615 B1 11/2012 Filteau et al.
9,924,746 B1 * 3/2018 Davis ..... A41B 9/023
10,398,183 B2 * 9/2019 Berns ..... A41D 27/205
10,750,793 B1 * 8/2020 Theodoridis ..... A41B 9/001
11,363,841 B2 * 6/2022 Schultz ..... A41D 1/00
11,375,756 B1 * 7/2022 White ..... A41B 17/00
2005/0278820 A1 * 12/2005 Newman ..... A41B 9/00 2/69
2007/0032771 A1 * 2/2007 Abed ..... A61F 13/49006 604/385.22
2007/0166503 A1 * 7/2007 Hannigan ..... A41D 31/102 428/59
2007/0218792 A1 * 9/2007 Walters ..... B32B 27/285 442/104
2008/0222766 A1 * 9/2008 Arensdorf ..... A63B 71/08 2/22
2010/0043123 A1 * 2/2010 Goodhand ..... A41D 31/185 2/228
2012/0023645 A1 * 2/2012 Murphy ..... A41B 9/12 2/400
2013/0019371 A1 1/2013 Abeysekera et al.
2013/0125293 A1 * 5/2013 Stearns ..... A41D 1/06 2/227
2014/0053322 A1 2/2014 Zamler
2015/0313302 A1 * 11/2015 Boyle ..... A41D 27/28 2/227
2016/0007662 A1 1/2016 Powell
2016/0295933 A1 10/2016 Herbener et al.
2016/0296384 A1 10/2016 Png et al.
2017/0266537 A1 * 9/2017 Zakem ..... A41D 13/05
2017/0360624 A1 * 12/2017 Nakashita ..... A61F 13/8405
2018/0199633 A1 * 7/2018 Henry ..... A41D 1/08
2018/0263299 A1 9/2018 Padin
2019/0320726 A1 * 10/2019 Profeta ..... A41B 17/00
2020/0054495 A1 * 2/2020 Pelt ..... A61F 13/5616
2020/0079051 A1 * 3/2020 Nicolson ..... B32B 5/16
2020/0170309 A1 * 6/2020 Ewell ..... B32B 5/024
2021/0162091 A1 * 6/2021 Swamy ..... A61F 13/84
2021/0177068 A1 * 6/2021 Karabetyan ..... A41B 9/023
2021/0206144 A1 * 7/2021 Ewell ..... A61F 5/44
2021/0259326 A1 * 8/2021 Shaughnessy ..... A41B 9/004
2021/0298369 A1 * 9/2021 Polstein ..... A41B 17/00
2022/0195879 A1 * 6/2022 Quach ..... F01D 11/005
2022/0331176 A1 * 10/2022 Rogers ..... A61F 13/15252

OTHER PUBLICATIONS

International Search Report, PCT/US2019/056265 (Jan. 13, 2020).
Written Opinion of the International Searching Authority, PCT/US2019/056265 (Jan. 13, 2020).
Knapp, Ken, "What Does Moisture-Wicking Mean?", https://www.rei.com/learn/-expert-advice/what-does-moisture-wicking-mean-html, Nov. 30, 2023.
Neat Apparel, "Moisture Absorption vs Moisture Wicking: They're Not Made Equal", https://www.neatapparel.com/blogs/news/moisture-absorption-vs-moisture-wicking, Apr. 12, 2021.

* cited by examiner

ATHLETIC GARMENT

BACKGROUND

Athletics often require clothing that afford protection to the user. Football players have padded uniforms and helmets to protect them from bruises and fractures. Soccer players require shin guards to prevent receiving a shin-related injury. Softball and baseball players require padded undergarments to protect from bruising and fractures during sliding into bases. Other sports require athletic garments such as compression shorts to be worn for protection and comfort of the wearer.

Athletic undergarments are typically formed of breathable material and are used to protect the wearer during participation in physical activity. Traditional athletic undergarments include a seam or a cross-seam running through the crotch region decreasing comfort during physical activity. Moreover, traditional athletic undergarments include a single-layered fabric of a spandex blend. Athletic undergarments typically provide no protection or concealment from visible exposure of any moisture, or fluid leakage during menstruation which often results in embarrassment and humiliation to the wearer.

SUMMARY

In an embodiment, an athletic garment is provided including a front panel, a rear panel, a first opening for receiving a torso of a user, a second opening for receiving a first leg of a user and a third opening for receiving a second leg of a user; and a crotch panel disposed between the front and rear panel, extending from the second opening to the third opening. The crotch panel comprises a tri-layered substrate to conceal and eliminate visible staining of a fluid received therein. The tri-layered substrate includes a first layer of a first material, a second layer of a second material, and a third layer of a third material.

In another embodiment, an athletic garment may include a first substrate for placement around a lower torso and upper legs of a user, the first substrate defining a first opening for receiving a portion of the torso, a second opening for receiving a first leg and a third opening for receiving a second leg of the user. The athletic garment may further include a crotch panel disposed between the second opening and the third opening, configured to be positioned at the crotch region of a user, wherein the crotch panel includes a second substrate, the second substrate having a multi-layered substrate to provide moisture control, and to conceal and prevent visible staining of a fluid received therein. The multi-layered substrate may include at least two layers, wherein a first layer includes a first material, a second layer includes a second material, and, optionally, a third layer includes a third material, wherein each layer of the multi-layered substrate includes a different material.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
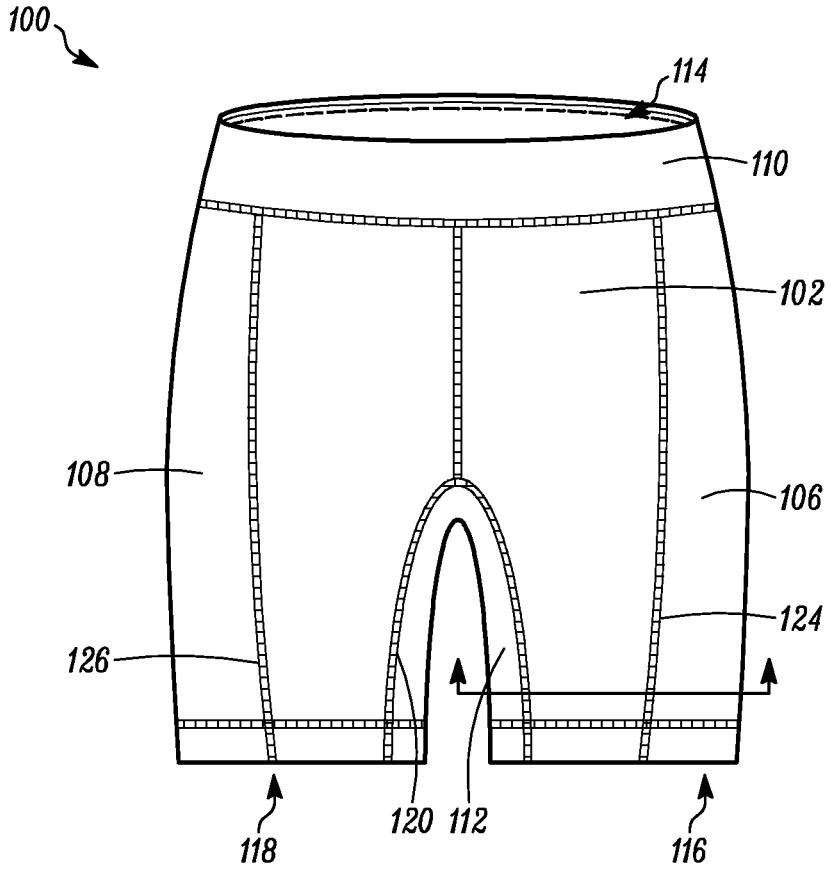
FIG. 1 is a front side view of an embodiment of an athletic garment.

For the purposes of promoting an understanding of the principles and operation of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to those skilled in the art to which the invention pertains.

It is to be noted that the terms "first," "second," and the like as used herein do not denote any order, quantity, or importance, but rather are used to distinguish one element from another. The terms "a" and "an" do not denote a limitation of quantity, but rather denote the presence of at least one of the referenced item. Furthermore, to the extent that the terms "including." "includes," "having," "has," "with," or variants thereof are used in either the detailed description and/or the claims, such terms are intended to be inclusive in a manner similar to the term "comprising." The modifier "about" used in connection with a quantity is inclusive of the stated value and has the meaning dictated by the context (e.g., includes the degree of error associated with measurement of the particular quantity). It is to be noted that all ranges disclosed within this specification are inclusive and are independently combinable.

The term "breathable" as used herein includes any fabric which allows the passage of air therethrough, including, but not limited to organic or non-organic cotton, spandex, jersey, mesh material, bamboo, or lace, among others, and may include, blends of various fabrics. When the breathable fabric includes a mesh material or other knit material, it may include small apertures integrally knit within, in a non-limiting embodiment. The breathable fabric may include an absorbent material or a moisture wicking material. In other embodiments, no apertures may be included in the material or fabric.

The terms "moisture absorbent" or "moisture absorbing" as used herein refers to materials or components of the athletic garments described herein, which absorb and capture moisture or fluid. Examples of moisture absorbent fabric known in the art includes cotton, modal, micro-modal, Tencel®, or other viscose-based fibers. Many of the moisture absorbent materials are made from plant cellulose, which attracts water. In some examples, moisture or fluid is absorbed into micropores in the fiber and is trapped therein.

The terms "moisture wicking" as used herein refers to a material or fabric used to move moisture away, also known as a water-resistant material. Moisture wicking materials often include synthetic fibers such as polyester or nylon, and/or any other fabric pretreated with a solution to prevent water absorption. Fluid typically remains as droplets on top of the fabric surface and may run along the weave of the fabric. Once the fluid reaches the outside of the fabric, and is exposed to air, it will evaporate. Moisture wicking materials dry quickly in moist conditions.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. As a non-limiting example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 7.

Embodiments described herein include an athletic garment including a construction providing optimal comfort and breathability to the wearer, while providing enhanced protection, maximizing ventilation, and facilitating good hygiene. Moreover, the athletic garment embodiments described herein are particularly beneficial for female wearers, as the crotch region of the garment includes, in one example, a tri-layered substrate, providing breathability in an increased moisture area, but also including an antimicrobial fabric and a moisture wicking fabric to prevent visible leakage during menstruation. The embodiments described herein, therefore, provide moisture management (i.e., leak prevention), moisture wicking, antimicrobial management, moisture wicking and moisture absorption, therefore enhancing comfort and providing concealment and protection for menstruating women wearers.

FIG. 1 is a front side view of an embodiment of an athletic garment 100. The athletic garment 100 includes a front panel 102, a rear panel 104, a first side panel 106 and a second side panel 108. The athletic garment 100 further includes a first opening for receiving a torso of a user, a second opening 116 and a third opening 118. The second and third openings 116, 118 are designed to receive and support the legs of a user. The garment 100 further includes a crotch panel 112 (e.g., a gusset) extending from the second opening 116 to the third opening 118, supporting the crotch region of a user. The crotch panel 112 may include a tri-layered substrate comprising a first layer 130, a second layer 132 and a third layer 134, as shown and described in reference to FIG. 3 and FIG. 4. In other embodiments, the garment 100 may include a single layer crotch panel 112 of varied materials, including a combination of moisture wicking, moisture absorbent, antimicrobial management material(s). In yet another embodiment, the crotch panel 112 may be formed, at least in part, of a two-layer substrate including materials of these types in order to manage moisture and support an antimicrobial environment. Lastly, the crotch panel 112 may include a more than three-layered substrate including one or a combination of these materials for moisture control and antimicrobial support.

In some non-limiting embodiments, the first side panel 106 may include a first padded portion 107 (shown in FIG. 4), and the second side panel 108 may include a second padded portion 109 (not shown). In these embodiments, the first and/or second padded portions 107, 109 may be removable from the first side panel and second side panel 106, 108. In some non-limiting embodiments, the first and second side panels 106, 108 may include respective pockets for receiving the first and second padded portions 107, 109. In other non-limiting embodiments, the first and second padded portions 107, 109 may be permanently affixed within the first and second side panels 106, 108. In other embodiments, the first and second side panels 106, 108 may not include padded portions.

Figure 2C:
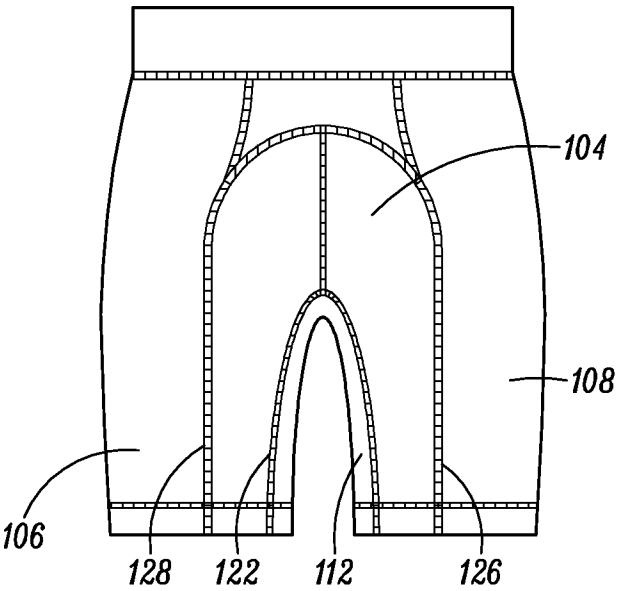
FIG. 2C is a back view of the embodiment of the athletic garment shown in FIGS. 2A-2B.
Figure 2B:
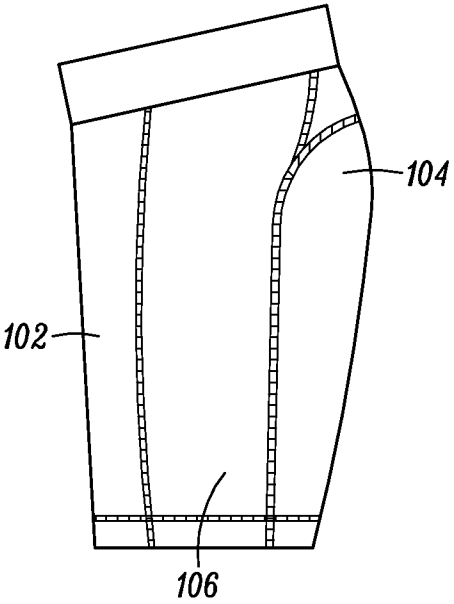
FIG. 2B is a side view of the embodiment of the athletic garment shown in FIG. 2A.
Figure 2A:
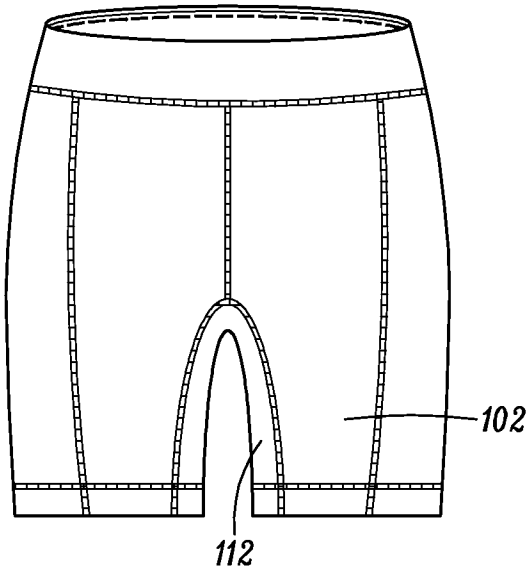
FIG. 2A is a front view of an embodiment of the athletic garment.

The athletic garment embodiment 100 may include a first front seam 120 joining the crotch panel 112 to the front panel 102, and a first rear seam 122 joining the crotch panel 112 to the rear panel 104 (first rear seam shown in FIG. 2C). A waistband portion 110 may be associated with a top portion of the garment 100, the waistband portion 110 defining the first opening 114, and configured to surround at least a portion of the torso of a user. The waistband portion 110 may be formed of an elastic material, in one embodiment.

The first side panel 106 may be disposed between and adjoined to the front panel 102 by way of a second front seam 124, and the rear panel 104 by way of a third rear seam 128. The second side panel 108 may be disposed between and adjoined to the front panel 102 by way of a third front seam 126, and the rear panel 104 by way of a second rear seam 126 as shown in FIGS. 1 and 2A-2C.

The placement of the crotch panel 112 (e.g., gusset), extending generally from the second opening 116 to the third opening 118 provides additional comfort in the crotch area while avoiding a crotch seam or cross-seam in this area during wear. The construction of the crotch panel 112, extending from the second opening 116 to the third opening 118, and bordered by a seam on either side of the crotch panel 112 enhances comfort while providing additional protection in this area over the typical triangular or rhomboidal gusset often found in garments. Moreover, this crotch panel 112 design allows for the crotch panel 112 to be formed as a tri-layer substrate.

Figure 3:
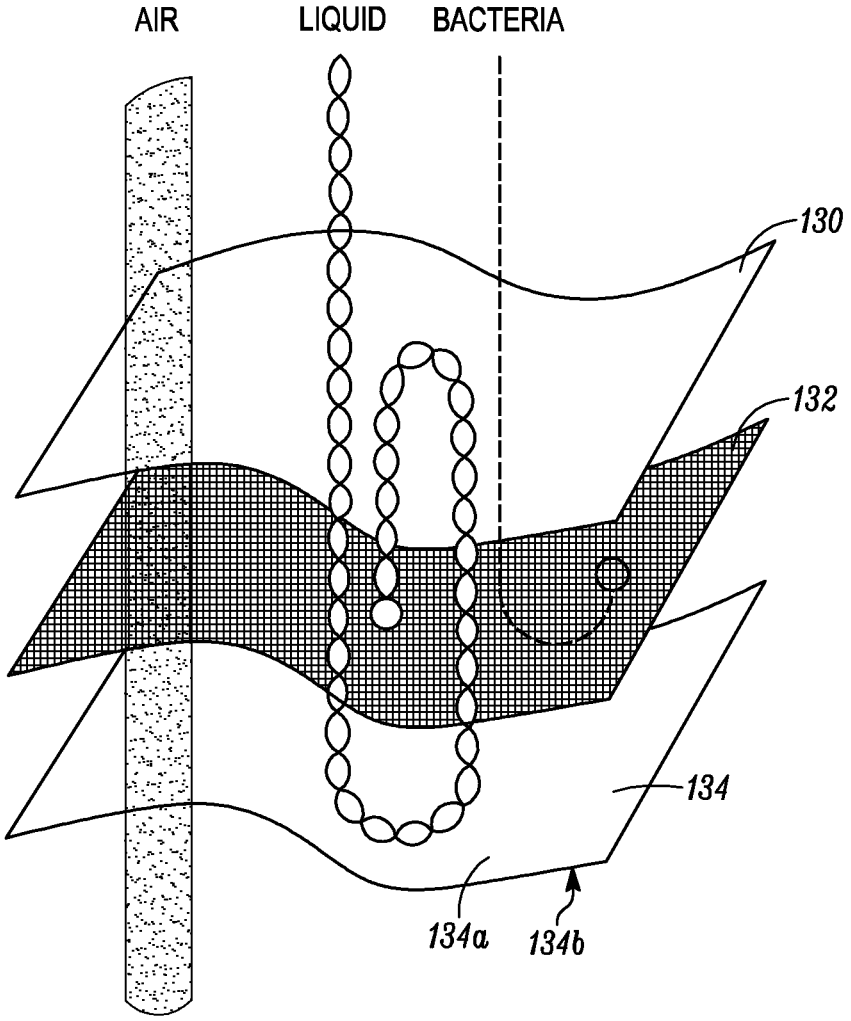
FIG. 3 depicts a structure of a tri-layer moisture management protection substrate in a crotch panel of an embodiment of the athletic garment.

The tri-layer substrate as shown in FIG. 3 may include a first (inner) layer 130, providing a breathable, soft, moisture absorbent breathable material allowing for the passage of air and fluid therethrough, a second (middle) layer 132 providing an antimicrobial, breathable, quick-dry, water repellent layer disposed between the first layer 130 and the third layer 134, and the third (outer) layer 134 includes a moisture wicking, quick dry anti-microbial treatment layer to prevent bacterial growth, or growth of any other unicellular or multicellular organism, and to wick away moisture from the first and second layers. The tri-layer substrate may extend over at least some or all of a crotch region of a user and may extend through the entire crotch panel 112 from the second opening to the third opening of the garment 100, in a non-limiting embodiment. The soft, absorbent, breathable layer positioned closest to the body of the wearer provides a breathable layer, the second layer 132, a layer separate and distinct from both the first layer 130 and the third layer 134, provides an antimicrobial water repellant quick dry layer. The second layer 132 may slow the flow of fluid in some examples and may be water resistant. The third layer 134 positioned furthest from the wearer allows for moisture wicking, quick dry and antimicrobial treatment. The layers may be attached to one another using, for example, stitches. In some non-limiting embodiments, the first layer may include a first material, the second layer may include a second material, and the third layer may include a third material. The first material may be different from the second and third materials, and the second material may be different from the third material.

The moisture wicking layer may be made of or include a moisture wicking material that transfers (and/or facilitates the transfer of) moisture or fluid from its surface (i.e., from the third layer 134 to the second layer 132, or the first layer 130). The moisture wicking layer may comprise, consist of, or include any moisture-wicking material known in the art. The material may be naturally moisture-wicking and/or be treated to include moisture-wicking properties. In one embodiment, the moisture-wicking material may include at least 50% cotton.

The moisture-wicking third layer 134 may include an inner surface 134*a* (closest to the second layer 132) and an outer surface 134*b*. Either of the inner surface or the outer surface 134*a*, 134*b* may be treated with a hydrophilic composition or material (e.g., polyethylene oxide, polyvinyl alcohol, polyacrylamide, poly acrylic acid, polyvinyl pyrrolidone, hydrophilic silicones, or hydrophilic polyurethanes) and/or a hydrophobic composition or material (e.g., silicones, polyfluoroalkylacrylates, polyacrylates, polyurethanes, or waxes) to create a net hydrophilic gradient over the third layer 134, for example, the inner surface 134*a* may be more hydrophilic whereas the outer surface 134*b* may be less hydrophilic (i.e., more hydrophobic), in a non-limiting example. As a result, a combination of a "water repelling" force generated by any hydrophobic properties of the outer surface 134*b* (and/or portions of the third layer 134 near the outer surface 134*b* and a "water loving" force generated by any hydrophilic properties of the inner surface 134*a* (and/or portions of the third layer 134 near the inner surface 134*a* layer may wick any moisture or fluid through the second layer 132, and/or the first layer 130, wherein the fluid may be absorbed.

The moisture absorbent material of the first layer 130 may comprise, consist of or include any fluid-absorbing material known in the art (e.g., cotton, a cotton blend, foam, a synthetic material, absorbent polymeric foam a nanotechnology-based or-produced material, or any other moisture-absorbent material).

The first layer 130 may include a cotton and spandex jersey blend, such as 80%-97% cotton and 20%-3% spandex jersey blend providing a soft, yet absorbent and breathable fabric, in a non-limiting example. In one particular non-limiting embodiment, the first layer 130 may include a 95% cotton and 5% spandex jersey blend. The second layer 132 may include an antimicrobial fabric or may include an antimicrobial application thereon. The third layer 134 may include a nylon and spandex jersey blend, including 70%-90% nylon and 30%-10% spandex jersey in non-limiting embodiments, to provide the moisture wicking, quick dry and antimicrobial benefits. In one particular non-limiting embodiment, the third layer 134 may include a fabric of 80% nylon and 20% spandex jersey.

The tri-layered substrate of the crotch panel 121 provides protection for female wearers providing moisture management protection. Moreover, the tri-layered substrate provides critical antimicrobial material for decreasing infections associated with bacteria, while providing enhanced comfort due to the sleek design. The athletic garment provides additional protection for the female wearer during menstruation and reduces the likelihood of exposure of a visible stain or uncomfortable fluid leakage from the user. In other embodiments, the tri-layered substrate, or any of the individual layers of the substrate may extend beyond the crotch panel 112, and into the front panel, rear panel or side panels 102, 104, 106, 108.

Figure 4:
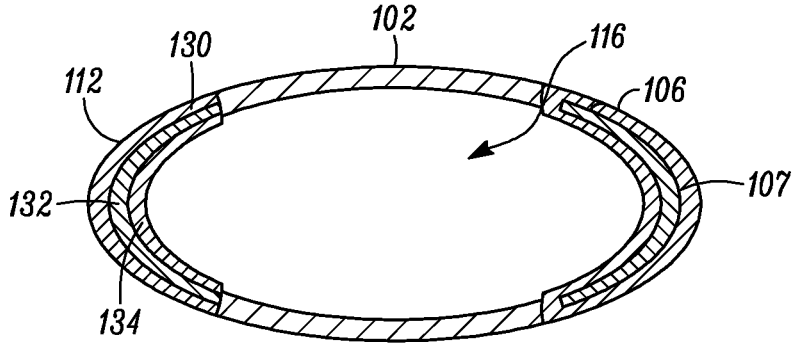
FIG. 4 is a cross-sectional view of the panels surrounding the second opening as shown in FIG. 1.

FIG. 4 provides a cross-sectional view of an embodiment of an athletic garment, the cross-sectional view taken at X-X of FIG. 1. While the area defining the multi-layer, substrate is shown with respect to one side of the garment, one skilled in the art will understand that the materials making up the crotch panel extend from one leg opening to the next in a continuous fashion. Therefore, the cross-sectional representation of FIG. 4 of one end of the crotch panel 112 at the second opening 116 is representative of the panel 112 at the third opening 118 or end thereof. The cross-sectional view of FIG. 4 shows the multi-layered substrate in the crotch panel 112 of the athletic garment, and shows the first padded portion 107 disposed within the first side panel 106. The front and rear panels 102, 104 are shown as single-layered panels; however, these panels may be formed of multiple layers in other non-limiting embodiments. Moreover, other embodiments may not include any padded portions. Alternatively, some non-limiting embodiments may include padded portions in the rear panel 104 and/or front panel 102. In another embodiment, an athletic garment is provided, including a first substrate for placement around a lower torso and upper legs of a user, the first substrate defining a first opening for receiving a portion of the torso. The garment may include a second opening for receiving a first leg, and a third opening for receiving a second leg of the user; and a crotch panel disposed between the second opening and the third opening configured to be positioned at the crotch region of a user. The crotch panel may include a second substrate, the second substrate may include a multi-layered substrate to provide moisture control, and conceal and prevent visible staining of a fluid received thereon. The multi-layered substrate may include at least two layers, wherein a first layer comprises a first material, a second layer comprises a second material, and, optionally, a third layer comprises a third material, wherein each layer of the multi-layered substrate comprises a different material.

The first substrate of the garment may include a material that is the same as at least one of the materials of the multi-layered substrate, in one non-limiting example. The material for the first substrate, for example, may comprise materials used in compression clothing such as compression shirts, sleeves and shorts. In another example, the first material, second material and optionally, a third material comprises a material selected from the following: a) moisture absorbent material; b) antimicrobial, water repellant material; and c) antimicrobial, moisture wicking material.

The materials described in specific embodiments herein may be substituted by materials that would be recognizable as compatible or equivalent by those skilled in the art. Moreover, chemicals, compounds, treatments, or other elements or features of the materials or fabrics, their design, or the process by which the fabrics or materials are created may be substituted by other known materials recognized by those skilled in the art to which the embodiments pertain.

It is important to an understanding of the present invention to note that all technical and scientific terms used herein, unless defined herein, are intended to have the same meaning as commonly understood by one of ordinary skill in the art. The techniques employed herein are also those that are known to one of ordinary skill in the art, unless stated otherwise. For purposes of more clearly facilitating an understanding the invention as disclosed and claimed herein, the following definitions are provided.

Finally, while various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims. The teachings of all patents and other references cited herein are incorporated herein by reference in their entirety to the extent they are not inconsistent with the teachings herein.

What is claimed is:

1. An athletic garment comprising:

a front panel, a rear panel, a first opening for receiving a torso of a user, a second opening for receiving a first leg of a user and a third opening for receiving a second leg of a user; and a crotch panel disposed between the front and rear panel, extending from the second opening to the third opening, wherein the crotch panel comprises a tri-layered substrate to conceal and prevent visible staining of a fluid received therein, the tri-layered substrate comprising a first, inner layer of a first material positionable adjacent a user of the athletic garment, the first material being a moisture absorbent material, a second, middle layer of a second material, the second material being a moisture repellant layer, and a third, outer layer of a third material positionable distal the user of the athletic garment, the third material being a moisture wicking material.

2. The athletic garment of claim 1, further comprising a first side panel and a second side panel, wherein the first side panel is disposed between the front panel and the rear panel, said first side, front, rear and crotch panels forming the second opening, and wherein the second side panel is disposed between the front and rear panels, the second side, front, rear and crotch panels forming the third opening.

3. The athletic garment of claim 2, wherein the first side panel further comprises a first padded portion.

4. The athletic garment of claim 2, wherein the second side panel further comprises a second padded portion.

5. The athletic garment of claim 2, wherein the first side panel comprises a first panel pocket.

6. The athletic garment of claim 2, wherein the second side panel comprises a second panel pocket.

7. The athletic garment of claim 1, wherein the material of the front panel and/or the rear panel are continuous with the third layer of material.

8. The athletic garment of claim 1, wherein the third layer of material is continuous between the front panel, the crotch panel, and the rear panel.

9. The athletic garment of claim 1, wherein a first front seam connects the crotch panel to the front panel.

10. The athletic garment of claim 1, wherein a first rear seam connects the crotch panel to the rear panel.

11. The athletic garment of claim 1, wherein a second front seam connects the front panel to the first side panel.

12. The athletic garment of claim 1, wherein a third front seam connects the front panel to the second side panel.

13. The athletic garment of claim 1, wherein a second rear seam connects the rear panel to the second side panel.

14. The athletic garment of claim 1, wherein a third rear seam connects the rear panel to the first side panel.

15. The athletic garment of claim 1, further comprising a waistband portion disposed at an upper portion of the garment.

16. The athletic garment of claim 1, wherein the material of the front panel and/or rear panel is the same as the first material, second material, or third material.

17. An athletic garment comprising:

a first substrate for placement around a lower torso and upper legs of a user, the first substrate defining a first opening for receiving a portion of the torso, a second opening for receiving a first leg and a third opening for receiving a second leg of the user; and a crotch panel disposed between the second opening and the third opening, configured to be positioned at the crotch region of a user, wherein said crotch panel comprising a second substrate, said second substrate comprising a multi-layered substrate to provide moisture control, and conceal and prevent visible staining of a fluid received therein, the multi-layered substrate comprising at least two layers, wherein a first layer comprises a first material positionable adjacent a user of the athletic garment, the first material being a moisture absorbent material, a second layer comprises a second material, the second material being a moisture repellant layer, and, optionally, a third layer comprises a third material positionable distal the user of the athletic garment, the third material being a moisture wicking material, wherein each layer of the multi-layered substrate comprises a different material.

18. The athletic garment of claim 17, wherein the first substrate comprises a material that is the same as at least one of the materials of the multi-layered substrate.

* * * * *